United States Patent [19]

Spisak et al.

[11] Patent Number: 4,566,251

[45] Date of Patent: Jan. 28, 1986

[54] CARTON FORMING, STERILIZING, FILLING AND SEALING MACHINE

[75] Inventors: Anthony F. Spisak, Redford; Sava Stefanovic, Southfield; Curtis H. Pawloski, Pontiac, all of Mich.

[73] Assignee: Ex-Cell-O Corporation, Troy, Mich.

[21] Appl. No.: 689,355

[22] Filed: Jan. 7, 1985

[51] Int. Cl.[4] ..... B65B 55/10

[52] U.S. Cl. ..... 53/167; 53/202; 53/279; 53/426; 53/565

[58] Field of Search ..... 53/425, 426, 279, 280, 53/565, 510, 511, 403, 407, 167, 202

[56] References Cited

U.S. PATENT DOCUMENTS

| | | | |
|---|---|---|---|
| 3,336,722 | 8/1967 | Van Der Winden | 53/426 |
| 3,566,575 | 3/1971 | Lisiecki | 53/467 X |
| 4,375,145 | 3/1983 | Mosse et al. | 53/467 |
| 4,409,775 | 10/1983 | Brody et al. | 53/426 X |
| 4,448,013 | 5/1984 | Nakajima | 53/565 |
| 4,456,118 | 6/1984 | Kauffman et al. | 493/182 |

*Primary Examiner*—James F. Coan
*Attorney, Agent, or Firm*—John P. Moran

[57] ABSTRACT

The disclosure illustrates and describes a modular forming, sterilizing, filling and sealing machine for containers, including a front bottom forming and sealing section; an intermediate sterilizing section; and a rear filling, top forming and sealing section; and separate conveyor means in each section. The conveyor means in the sterilizing section is adapted to receive the containers from the conveyor means in the bottom forming and sealing section in an upright, open-topped condition and convey same transverse to the line of travel in the forming and sealing sections through a sterilant vapor atmosphere wherein the sterilant vapor condenses on all surfaces of each upright, open-topped container, and then rotates the containers from the upright position to an upside-down condition through a heated and air blown atmosphere, and back to an upright condition onto the conveyor means in the filling, top forming and sealing section.

7 Claims, 5 Drawing Figures

CARTON FORMING, STERILIZING, FILLING AND SEALING MACHINE

TECHNICAL FIELD

This invention relates generally to forming, sterilizing, filling and sealing machines for containers and, more particularly, to a modular type machine indexing two cartons at a time, and wherein a transverse sterilizing section serves to sterilize the cartons intermediate the bottom forming station and the filling station.

BACKGROUND ART

Forming, sterilizing, filling and sealing machines have incorporated various techniques heretofore to sterilize paperboard cartons for carrying non-carbonated or "still" liquids, such as juices. One such machine is shown and described in U.S. Pat. No. 3,566,575, wherein a hydrogen peroxide mixture is supplied via a fogging nozzle into the open tops of cartons being fed "in-line" through an enclosed chamber, and heated therein to remove the fog from the cartons just prior to being filled with the designated liquid.

U.S. Pat. No. 4,375,145 discloses an aseptic packaging machine wherein cartons are conveyed along a path in an aseptic chamber including an advance leg and a return leg, each along the length of the machine, with the open-topped cartons being subjected to overhead ultra-violet germicidal lamps and a fine spray of hydrogen peroxide.

DISCLOSURE OF THE INVENTION

An object of the present invention is to provide an improved, high-speed, forming, sterilizing, filling and sealing machine wherein the sterilization operation is performed in a laterally extending direction, thereby providing an extended sterilizing time period without having to lengthen the machine to provide such additional sterilizing time.

Another object of the invention is to provide a modular type packaging machine wherein a transverse carton sterilization section is cooperatively inserted intermediate the bottom forming and sealing section and the section for filling and top forming and sealing.

A further object of the invention is to provide a modular type packaging machine processing cartons in aligned pairs from a bottom forming and sealing section into a sterilization section, wherein they are sterilized while being conveyed laterally in side-by-side pairs from an upright, open top position, into an up-side-down position, and then back into the upright position immediately downstream of the starting upright position for continued processing in aligned pairs through filling and top forming and sealing stations.

Still another object of the invention is to provide such a modular type packaging and sterilizing machine wherein the pairs of cartons are lifted into engagement with an endless conveyor and subjected to a sterilant vapor at a temperature substantially higher than that of the cartons, causing the vapor to condense on all surfaces of the carton, and then turned upside down by the endless conveyor to allow any condensate to drain therefrom while being dried prior to being lowered in an upright position just ahead of first lifting station.

These and other objects and advantages of the invention will become more apparent when reference is made to the following description and accompanying drawings.

BEST MODE OF CARRYING OUT THE INVENTION

Figure 1A:
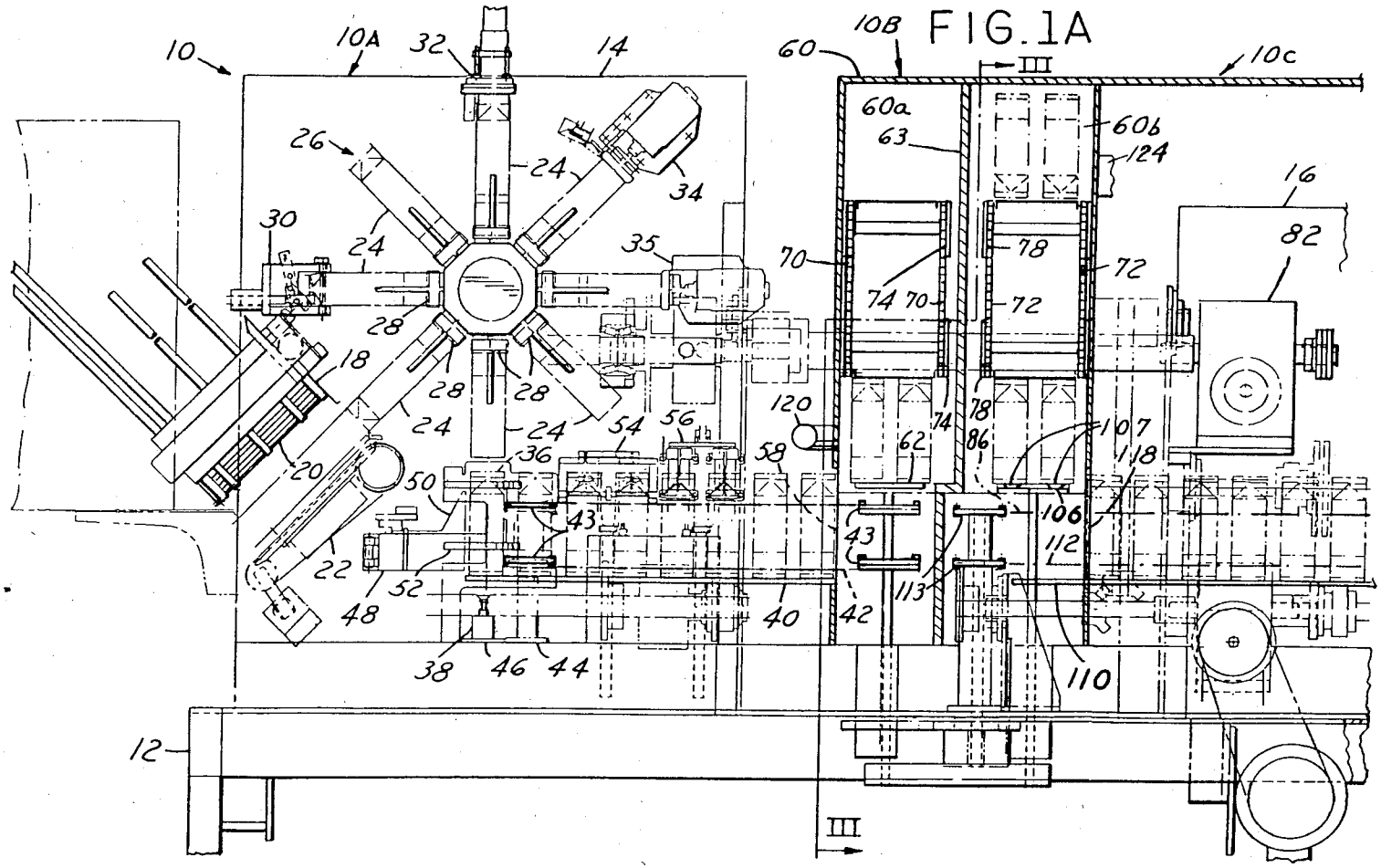
FIGS. 1A and 1B, taken together, are a side elevational view of a machine embodying the invention.
Figure 1B:
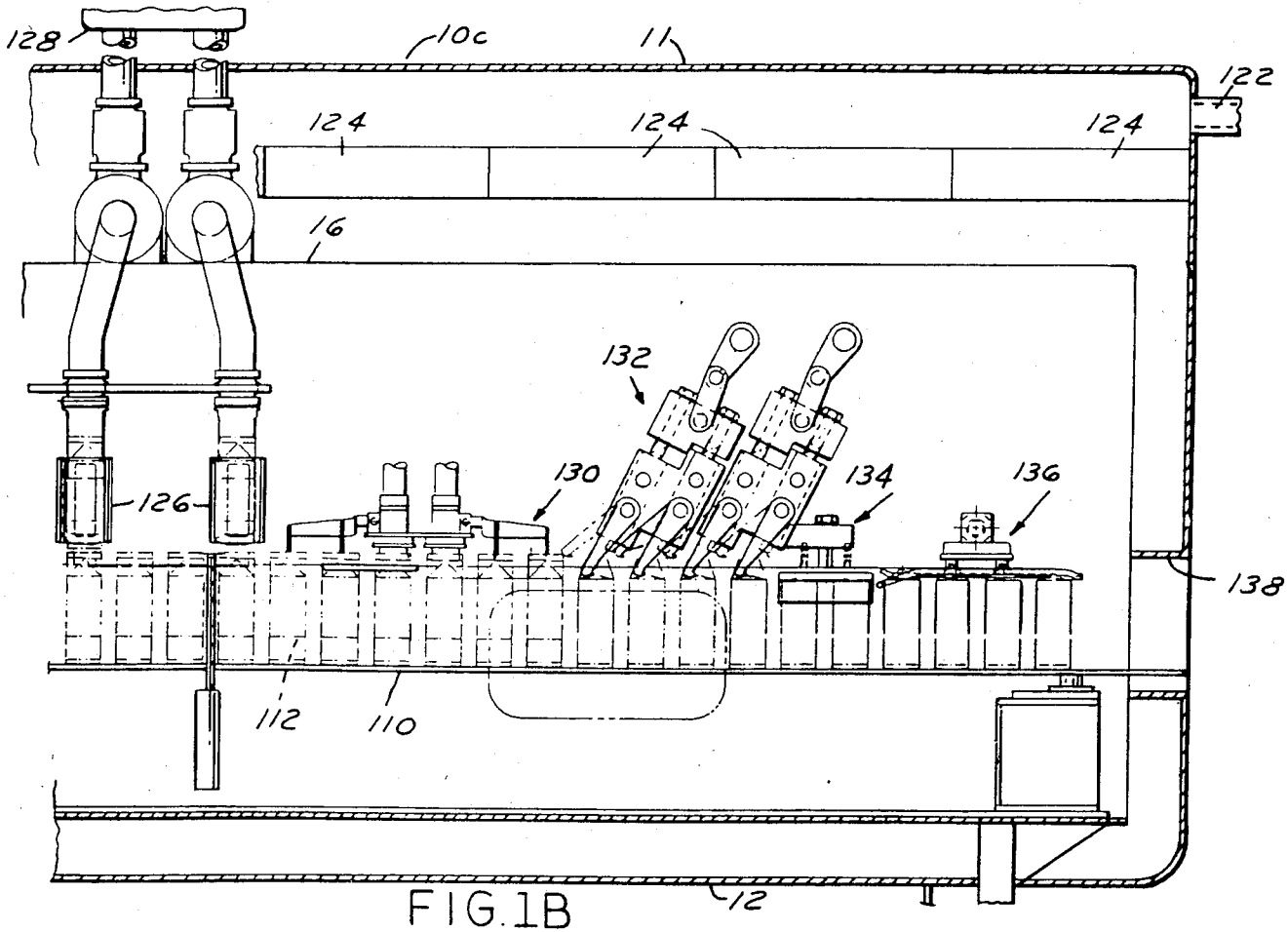
Figure 2:
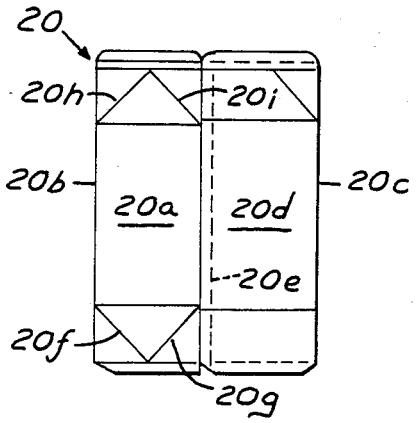
FIG. 2 is a layout view of a carton blank after it has been folded from a flat blank and side seamed into a four-sided flat structure suitable for being further formed into a rectangular tube, bottom sealed, filled with a liquid, and top sealed by the FIG. 1 machine embodying the invention.

Referring now to the drawings in greater detail, FIGS. 1A and 1B illustrate a modularly constructed forming, sterilizing, filling and sealing machine 10 of the liquid packaging type, including a bottom forming and sealing section 10A, a sterilizing section 10B, and a filling, top forming, and sealing section 10C. The latter is enclosed in a suitable housing, represented as 11, to retain an ultra-clean atmosphere therein. A base frame 12 supports the three sections, and vertical support keels 14 and 16 are mounted along the longitudinal axis of the frame for the sections 10A and 10C. The loading, bottom forming and sealing, sterilizing, filling, and top forming and sealing components are mounted on one side of the keel 14 as follows:

A magazine 18 for holding a plurality of paperboard blanks 20 is mounted on the one side of one end of the keel 14. The blanks 20, as illustrated in FIG. 2, may consist of four full width side panels **20*a*, 20*b*, 20*c* and 20*d*, and a side seam flap 20*e*, with the panels 20*b* and 20*c* being folded behind the panels 20*a* and 20*d*, respectively, and the flap 20*e* sealed to the inner edge portion of the panel 20*c*, as shown and described in U.S. Pat. No. 3,270,940. If desired, the blanks 20** may be of the flat top type, as shown and described in U.S. Pat. No. 4,422,570.

A loading mechanism 22 is mounted on the keel just below the magazine 18 and adapted to withdraw one blank at a time from the magazine while opening same into a foursided tube and then to load such individual tube into one of a plurality of mandrels 24 of an indexable turret mechanism 26. The latter is rotatably mounted on an upper portion of the keel 14. The receiving mandrel is positioned at 7:30 o'clock (FIG. 1A) when a paperboard tube is slid thereon by the loading mechanism 22. An adjustable stop member 28 may be operatively connected to each mandrel 24 to accommodate the forming of cartons having the same cross-section but different heights.

The mandrel indexes clockwise in FIG. 1A to a 9:00 o'clock position where two of the usual four bottom closure panels of the tube are pre-broken along preformed score lines **20*f* and 20*g* (FIG. 2) by a pre-breaker unit 30. At the 12:00 o'clock position, the four bottom closure panels are heated by a suitable heater 32 extending over the upper edge of the keel 14** above the 12:00 o'clock mandrel. The bottom heated tube and mandrel 24 are next indexed to 1:30 and 3:00 o'clock positions where duplicate closing and sealing units 34 and 35 close the bottom panels into an overlapped flat configuration, and under pressure, seal the overlapped panels together, changing the tube into a bottom sealed, open top container 36 or carton suitable for holding a liquid. Thereafter the bottom sealed carton is indexed to a 4:30 o'clock position where it continues to cool, prior to being indexed to an unloading 6:00 o'clock position.

At the latter position, the carton 36 is stripped from the mandrel 24 by a stripping unit 38 and pulled downwardly to rest on a stationary rail 40 extending laterally from between a pair of parallel endless conveyors 42 mounted around sprockets 43. As may be noted in FIG. 1A, the rail 40 is supported on brackets 44 mounted on one side of the keel 14. The stripping unit 38 is also mounted on the keel 14, supported thereon by a bracket 46. As the conveyors 42 index rightward in FIG. 1A, the rotation of the turret mechanism 26 is coordinated with the movement of the conveyors so as to continuously supply bottom sealed cartons to the stripping unit 38 and, thence, to the rail 40 at regular intervals, ready for transfer to the conveyors in the following manner and operational sequence, as shown and described in U.S. Pat. No. 4,456,118 covering "Single to Dual Indexing Carton Transfer Mechanism", and incorporated herein by reference.

With the carton 36 thus seated on the rail 40 it is in position to be transferred. During the dwell period of the conveyors 42, a transfer mechanism 48 including a suitable pusher 50 moves the first bottom-formed carton to the right in FIG. 1, along the rail 40 between guides 52, to a point just past a pair of oppositely disposed fixed spring fingers (not shown) and just behind oppositely disposed lugs of a pair of links (not shown) of the conveyors 42. The lugs thus form the front of a conveyor pocket. As the conveyors begin their indexing cycle, oppositely disposed lugs of the next pair of links contact the rear edges of the carton and form the rear of the conveyor pocket. The lugs continue to advance the carton, and the pusher 50 retracts. Oppositely disposed central lug members intermediate adjacent links, serve as a guide to each carton.

During the transfer period, the next mandrel 24 of the turret 26 indexes to the 6:00 o'clock position where the next carton 36 is stripped from the mandrel by the stripping unit 38 and deposited on the rail 40, in position to be transferred. While the indexing cycle of the conveyors 42 is in process, the pusher 50 moves this newest carton horizontally along the rail 40 into the entrance to the parallel conveyors 42 behind the now moving lugs of the links. In this instance, the pusher 50 is adapted to move a predetermined distance farther than it did for the preceding carton, in order to help assure that the carton keeps up with the moving conveyors until engaged thereby. The next-in-line lugs of the next pair of links are spread far enough apart, by virtue of being positioned around the horizontally oriented drive sprockets of the conveyors 42, to permit passage of the carton therepast. Once again the pusher 50 retracts, as the lugs form the rear of the conveyor pocket, and the turret 26 indexes to present another carton to the stripper mechanism 38, ready for the next cycle of delivering two cartons from the turret 26 for each one index of the conveyors 42.

If desired, the ends of the blank 20 can be reversed, such that the end bearing the diagonal score lines 20*h* and 20*i* is closed on the mandrels 24, with the open end bearing the diagonal score lines 20*f* and 20*g*.

After a predetermined number of indexes of the conveyors 42, each succeeding pair of cartons is positioned beneath a first pair of top pre-breaker units 54 where the two oppositely disposed panels of each carton are prebroken inwardly along their respective diagonal infold score lines 20*h* and 20*i* (FIG. 2 or 2A). Each pair of cartons is next indexed into position beneath a second pair of top pre-breaker units 56 where the same two oppositely disposed panels of each carton are now prebroken outwardly along the same diagonal score lines 20*h* and 20*i*. Each pair is then indexed twice, whereupon they leave the conveyor 40 and are pushed through an inlet opening 58 (FIG. 3) into an enclosed sterilization housing 60 and onto the platform of a lifter 62 which is positioned between the right end portion (FIG. 1A) of the parallel conveyors 42. A partition wall 63 (FIG. 1A) divides the chamber 60 longitudinally into chambers 60*a* and 60*b*.

Figure 4:
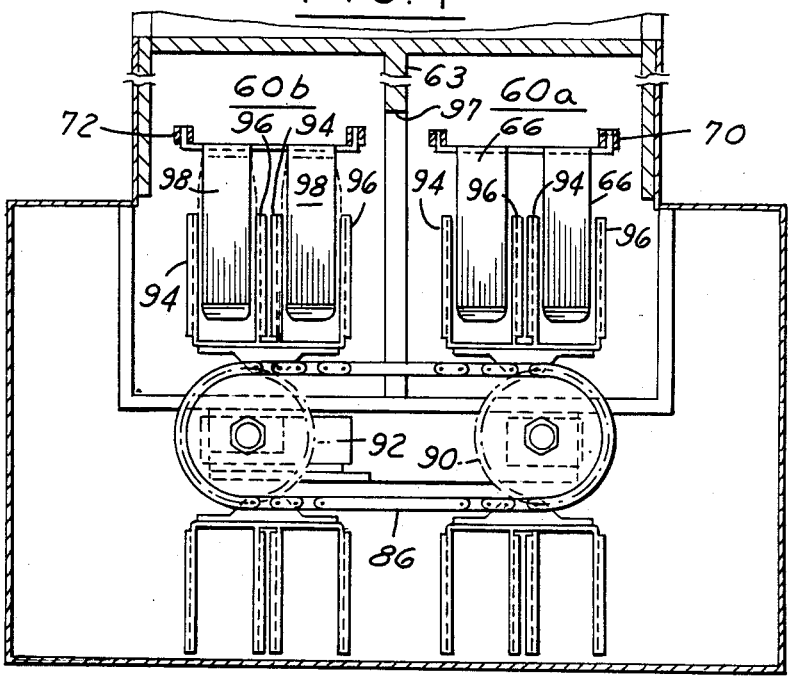
FIG. 4 is a cross-sectional view taken along the plane of the line 4—4 of FIG. 3, and looking in the direction of the arrows.
Figure 3:
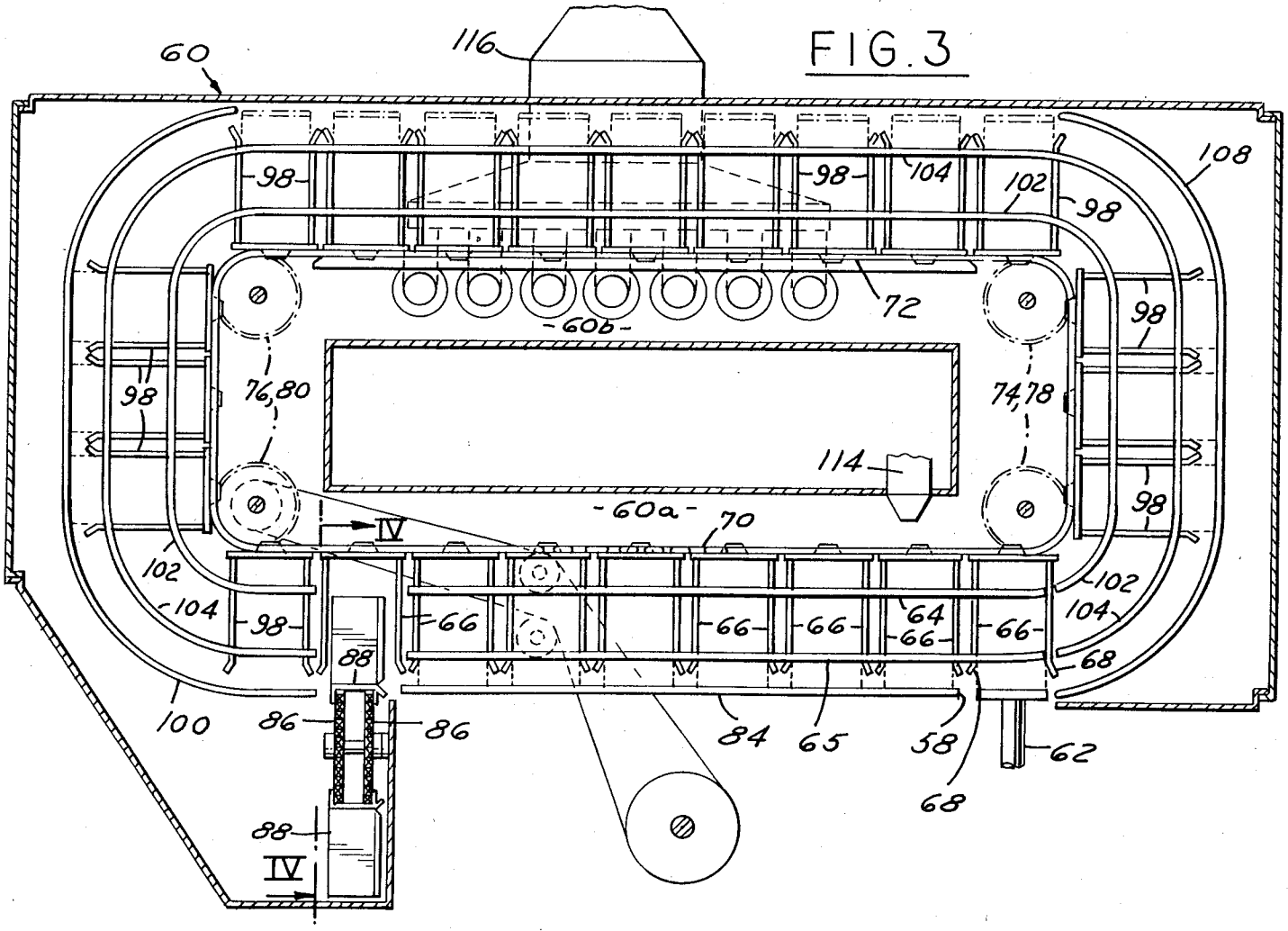
FIG. 3 is a cross-sectional view showing portions of two adjacent chambers, taken substantially along the plane of the line 3—3 of FIG. 1A, and looking in the direction of the arrows.

Once in the chamber 60*a*, the lifter 62 serves to lift each entering pair of open-topped cartons, inserting the pair between two respective fixed, inner and outer, longitudinally extending rails 64 and 65 (FIG. 1A) and respective front and back U-shaped retainer clips 66 (FIG. 4), each of which includes an out-turned bend 68 at its distal end to guide the entry of a carton therebetween. The clips are secured to a pair of front endless chains 70. The wall 63 separates the front chains 70 from a pair of back endless chains 72 (FIG. 1A) in the chamber 60*b*, both chains being mounted for indexing rotation around respective pairs of front and rear sprockets 74/76 and 78/80 (FIG. 3), the lower rear sprocket 80 being the drive sprocket, driven by suitable external motor means 82 (FIG. 1A). Once lifted, the platform of the lifter 62 serves to allow the cartons to be slid therefrom by the trailing clip 66 onto a fixed track segment 84 (FIG. 3). The track segment 84 extends parallel to and below the chain 70 for a portion of the length thereof, terminating just below the ends of the rails 64 and 65.

A further set of parallel endless chains 86, (FIG. 3) including a platform 88, are mounted around respective pairs of drive and driven indexable sprockets 90 and 92 (FIG. 4), such that the top surface of the platform is on the same plane as the upper surface of the track segment 84, as may be noted in FIG. 3. Open sided, spaced walls 94 and 96 (FIG. 4) are mounted on the chains 86 and 88 such that adjacent pairs of walls receive a side-by-side pair of cartons from the front chain 70 (FIG. 4) for lateral indexing movement of the chains 86 and 88 through an opening 97 formed in the partition wall 63 between the chambers 60*a* and 60*b*, toward the back chain 72, whereupon a pair of cartons is deposited between adjacent pairs of front and back U-shaped retainer clips 98 (FIG. 3), identical to the clips 66 of the front chain 70. The cartons are now ready to be moved by the chains 72 toward the rear of the machine onto a track segment 100 and between respective pairs of inner and outer rails 102 and 104. As shown in FIG. 3, the track segment 100 and the rails 102 and 104 extend in an arc around the lower or drive sprocket 80, and then vertical until they arc around the upper sprocket 80, whereupon the track segment 100 ends, while the rails 102 and 104 extend through the chamber 60*b* for the length of the back chains 72 and thence arc around the front upper sprocket 78, extend vertically downward and arc around the lower sprocket 78, terminating adjacent a stripper 106 (FIG. 1A), including vacuum cups 107. A third track segment 108 (FIG. 3) parallels the rails 102 and 104 around the front sprockets 78 to retain the cartons at their bottoms.

The respective pairs of cartons are then deposited on the vacuum cups 107 of the stripper 106, at which point they are lowered by the stripper (FIG. 1A) onto a rail 110 extending between another pair of parallel endless conveyors 112 of the filling and sealing section 10C, the conveyors 112 being mounted around sprockets 113.

While making the complete pass from the lifter 62 to the stripper 106, a vapor of a suitable sterilant, such as a hydrogen peroxide solution, is supplied from a source of sterilant (not shown) via suitable nozzle inlet means 114 through a wall of the chamber 60*a*, aimed generally at the open tops of the first pair of cartons one index after the lifter 62 station, and providing a saturated environment which is maintained at a predetermined temperature by any suitable means. Each open topped carton enters the sterilizing chamber at a temperature lower than that of the vapor so as to cause the vapor to condense on all surfaces of the carton. Traveling around the chains 70, 86, and 72 provides sufficient time for the sterilant vapor to "stew", with any condensate in the cartons being drained therefrom as they pass across the top of the chains with their open ends down (FIG. 3). During such travel the cartons are dried, being subjected to heat from suitable heater means 116.

While travelling from the chains 70 to 86 to 72, the successive cartons are subjected to clean high efficiency particulate air, commonly referred to as "HEPA", entering the chamber 60*b* from the section 10C via an opening 118 (FIG. 1A) between the section 10B and the section 10C at the lower front portion of the chamber 60*b* on the back chain 72 side thereof, and being blown the length of the chamber 60*b*, and thence through the opening 97 in the partition wall 63 across the length of the chains 86, to an outlet 120 from the left side (FIG. 1A) of the chamber 60*a*. The entire section 10C is subjected to the clean HEPA air by virtue of air entering the section 10C through an inlet 122 (FIG. 1B) from a suitable source (not shown) and passing through filters 124.

Once deposited by the stripper 106 (FIG. 1A) between the parallel conveyors 112, the cartons 36 are indexed through the outlet opening 118 into position beneath a pair of filling units 126 (FIG. 1B) of the section 10C, each of which feeds a measured volume of a particular product, such as milk, juice, or other pumpable product, from a source 128 into the cartons. As the cartons index in pairs therefrom, their conventional tops are broken, folded, heated, and sealed in the conventional manner by respective breaking, folding, heating, and sealing units 130, 132, 134 and 136 mounted on the keel 16. Thereafter, at the end of the forward travel of the endless conveyors 112, the filled and closed cartons are discharged through an outlet opening 138 onto any suitable track or conveyor unit (not shown) to be readied for shipment.

Industrial Applicability

It should be apparent that the invention provides an efficient and compact modular forming, sterilizing, filling and sealing machine wherein substantial sterilization time is gained with minimal additional overall machine length by virtue of the inclusion of a transversely arranged sterilizing unit.

It should also be apparent that the invention provides a modular, transversely arranged sterilization unit which is compatible with carton bottom forming and filling sections and wherein the cartons are subjected to a sterilant vapor which condenses on all surfaces of the carton to effectively sterilize same in the transverse sterilization unit.

While but one embodiment of the invention has been shown and described, other modifications thereof are possible within the scope of the following claims.

The embodiments of the invention in which an exclusive property or privilege is claimed are defined as follows:

1. A modular forming, sterilizing, filling and sealing machine for containers, said machine comprising a front bottom forming and sealing section; an intermediate sterilizing section; and a rear filling, top forming and sealing section; and separate conveyor means in each section, said conveyor means in said sterilizing section adapted to receive the containers from said conveyor means in said bottom forming and sealing section in an upright, open-topped condition and conveying same transverse to the line of travel in said forming and sealing sections through a sterilant vapor atmosphere wherein the sterilant vapor condenses on all surfaces of each upright, open-topped container, and then rotating the containers from the upright position to an upside-down condition through a heated and air blown atmosphere, and back to an upright condition onto said conveyor means in said filling, top forming and sealing section.

2. The machine described in claim 1, wherein said separate conveyor means are all caused to index simultaneously.

3. The machine described in claim 1, wherein said conveyor means in said sterilizing section includes a first endless conveyor for transferring said containers through said sterilant vapor atmosphere at a lower level, a second endless conveyor parallel to said first endless conveyor for turning said containers upside-down and transferring them through said heated and air blown atmosphere at an upper level, and a third endless conveyor for transferring said containers from said first endless conveyor to said second endless conveyor.

4. The machine described in claim 3, wherein said conveyor means in said sterilizing section includes a lifter unit to transfer the upright, open-topped containers from said conveyor means in said bottom forming and sealing section to said first endless conveyor, and a stripper unit to return the upright, open-topped containers from said second endless conveyor to said conveyor means in said filling, top forming and sealing section.

5. The machine described in claim 3, wherein each of said first, second and third endless conveyors includes a chain and front and back retainer members secured to the respective chains and forming compartments for retaining each container during its transfer from one chain to another, and fixed side rails on both sides of each aligned row of containers.

6. The machine described in claim 3, and a partition wall separating said heated sterilant vapor atmosphere from said heated and air blown atmosphere except for the vicinity of said third endless conveyor.

7. The machine described in claim 5, wherein each chain accommodates two rows of side-by-side containers.

* * * * *